US005469584A

United States Patent [19]

Casartelli

[11] Patent Number: 5,469,584

[45] Date of Patent: Nov. 28, 1995

[54] CRASH-HELMET FOR MOTORCYLISTS, CYCLISTS AND THE LIKE, PROVIDED WITH A SUNSHADE FRONT-PIECE OF RIGID MATERIAL

[75] Inventor: Gabriele Casartelli, Clamart, France

[73] Assignee: E.D.C. Sarl, Issy Les Moulineaux, France

[21] Appl. No.: 226,716

[22] Filed: Apr. 12, 1994

[30] Foreign Application Priority Data

Apr. 13, 1993 [EP] European Pat. Off. ..... 93105997

[51] Int. Cl.[6] ..... A42B 3/04

[52] U.S. Cl. ..... 2/422; 2/12; 2/424

[58] Field of Search ..... 2/6.2, 12, 9, 410, 2/422, 424, 425, 195.1, 175.6, 10, 11, 13; 403/345, 365, 369

[56] References Cited

U.S. PATENT DOCUMENTS

| | | | |
|---|---|---|---|
| 3,239,842 | 3/1966 | Marchello | 2/422 |
| 4,475,254 | 10/1984 | Bay . | |
| 4,653,123 | 3/1987 | Broersma . | |
| 4,794,652 | 1/1989 | Piech von Planta et al. | 2/12 X |

FOREIGN PATENT DOCUMENTS

| | | | |
|---|---|---|---|
| 0052067 | 10/1981 | European Pat. Off. . | |
| 0479407 | 9/1991 | European Pat. Off. . | |
| 2561079 | 3/1985 | France . | |
| 3700737 | 7/1987 | Germany | 2/410 |
| 279397 | 6/1990 | Germany | 2/12 |
| 1286758 | 7/1970 | United Kingdom . | |

*Primary Examiner*—C. D. Crowder
*Assistant Examiner*—Michael A. Neas
*Attorney, Agent, or Firm*—Collard & Roe

[57] ABSTRACT

Crash-helmet is provided with a sunshade visor front-piece, in which the front-piece is made of rigid material and is jut-fixed to connection side pins of the visor by using cogs. The cogs are partly deformable and so sized as to permit the prompt detachment of the front-piece from the helmet pins in case the user should fall or hit against obstacles.

3 Claims, 1 Drawing Sheet

CRASH-HELMET FOR MOTORCYLISTS, CYCLISTS AND THE LIKE, PROVIDED WITH A SUNSHADE FRONT-PIECE OF RIGID MATERIAL

DESCRIPTION

The object of this invention is a crash-helmet for motorcyclists, cyclists and the like, provided in the front part of a front-piece having virtually the form of a jutting top of rigid material.

As known, crash-helmets in general, and in particular the integral ones for motorcyclists and the like have in some cases, besides a visor of transparent material, also a small top, called front-piece, projecting almost horizontally with respect to the helmet and stably fixed above the visor, and whose function is that of protecting the open front of the helmet from sun rays.

The present front-pieces are made of elastically deformable or soft material, in order to permit their deformation in case of fall of the user or of his hitting against obstacles, without causing damages to said user; in fact, it is well known that, for safety reasons, crash-helmets, either the integral ones or the so-called "jet" ones, i.e. having an open front, must not have any rigid element projecting from the cap, as in case of anomalous stresses this element would cause the helmet to rotate, with severe troubles and dangers for the user.

The present front-piece or soft or anyhow deformable material, being rigidly fixed to the front of the helmet, solve only partly the problem of safety in case of fall or frontal hittings, inasmuch, even though their maximum projection reduces through deformation, they still are a projecting element, rigidly integral with the cap, which may cause damages to the user in case of fall or hittings, ensuing from possible shifts and/or partly rotations of the helmet with respect to its correct position. Besides, front-pieces of soft material are subject to vibrations during the driving which may create troubles to the user.

Object of this invention is therefore the realization of a crash-helmet provided with a front-piece designed and structurated in such a way as to fully avert the drawbacks caused by the known front-piece of soft or deformable material, and especially suitable to ensure the utmost safety in case of fall of the user or of hittings against possible obstacles.

A further object of this invention is the realization of a front-piece designed in such a way as to be structurally simple and reliable, fixable to the usual pins or connections of transparent visors, without creating remarkably greater encumberances on the outside and obviously on the inside of the cap.

Still a further object of this invention is the creation of a sunshade front-piece very light and vibration-resistant during the driving, and such as to be utilizable on helmets of either the integral type or of the open-front type.

These and still further objects which will be more clearly disclosed in the following description are obtained with a crash-helmet provided with a front-piece, wherein said front-piece is made, according to this invention, of rigid and light material and is stably jut-fixed to the usual connection side pins of the visor by means of cogs partly deformable and so sized as to permit the prompt detachment of said front-piece from said helmet pins in case of fall of the user and/or of frontal hittings against obstacles.

In particular, said cogs are constituted by a plurality of elements shaped as stepped-teeth or teeth, integrally projecting within two circular openings, each such opening being provided on the opposite sides of the front-piece in such a way as to be coaxially arrangeable with respect to one of said connection pins, the holding of the front-piece being obtained by the partial fitting of the ends of said teeth into an annular housing defined between the usual head of said connection pins and the annular body already provided for the rotatory holding of the visor.

Besides, said stepped-teeth or teeth are integral with the front-piece body by means of a smaller section part, causing said front-piece, in case of hitting or fall of the user, to facilitate the coming out of the teeth from the relevant annular housings, following the deformation undergone by said smaller sections.

Further characteristics and advantages of this invention will appear more clearly from the following detailed description, made with reference to the attached drawings, which are to be construed as a mere indication, wherein:

FIG. 4 is a detail, and namely the conformation of the connection zone only of the front-piece to the helmet clamping pin, while

Figure 1:
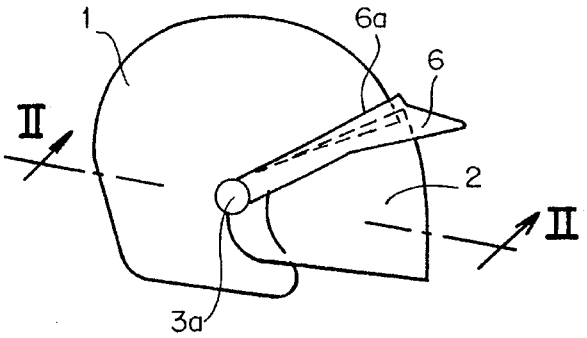
FIG. 1 is a schematic prospect of a crash-helmet with visor and piece-front realized according to this invention.

With reference to said figures, the crash-helmet 1 subject of this invention is of the traditional type and size and provided with a transparent visor 2, which can be lifted and lowered around two opposite fixation pins 3.

More in detail, the helmets of this type, i.e. those having an adjustable visor, are usually equipped, on two opposite zones of cap 1, with an annular element 4, placed on the cap and coaxial with respect to a hole 5 provided in the same; around said annular element 4 a usual transparent visor 2 is rotatably mounted, whose thickness, in correspondence of eyelet 2*a* rotatably engaged on element 4, is slightly smaller than the thickness of the annular element 4, in order to permit the clamping of said element 4 to the cap through pin 3 provided with a ledge head 3*a*. Hence, element 4 remains clamped on the cap,the inner surface of head 3*a* being a side holding element for the visor during its rotations.

The sunshade piece-front subject of this invention is stably hooked between said heads 3*a* and said element 4 of support and rotation of the visor, and can uncouple in case of hittings against obstacles or fall of the helmet user.

To this purpose, the front-piece 6 is constituted by a strip of opaque rigid plastic material, arched substantially in the same way as the external front surface of the cap and of a traditional shape, i.e. virtually trapezoid or almost triangular.

Figure 4:
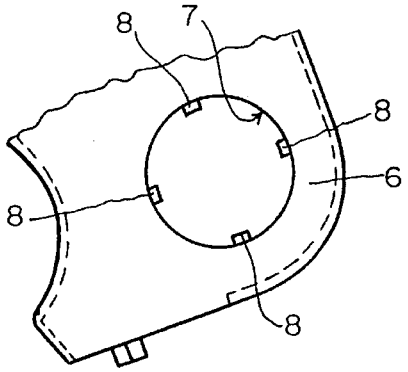
Figure 2:
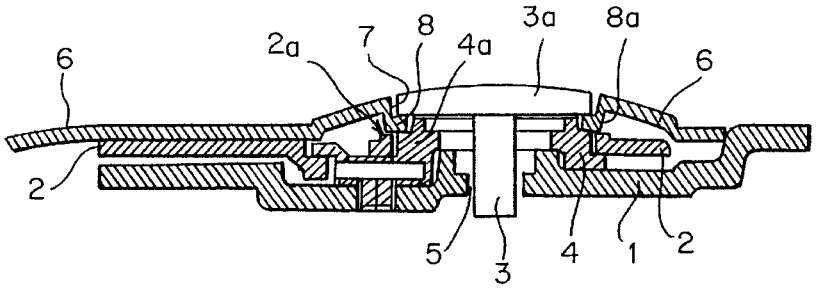
FIG. 2 is a section according to the II—II line of FIG. 1, said section being parallel to the base plane of the helmet and illustrating the front-piece fixed to one of the two usual connection pins.

Said front-piece 6 is fixed to the helmet in a basically horizontal position, forming a jutting top with respect to the front opening la of the helmet (FIG. 1). The fixation means of front-piece 6 to the helmet are constituted by a large circular opening 7, provided on the opposite ends of the greater base 6a of the trapezoid body (FIG. 4), at whose inner edge stepped-teeth 8 are provided, each such tooth being radially orientated towards the inside of the relevant opening 7 and made integral with the edge of said opening by means of a peduncle 8*a* (FIG. 5–5*a*) having a smaller cross-section with respect to the one of said teeth 8. The distance from one another of said circular openings 7 is such as to permit their being placed coaxially to the opposite pins 3 and the rotatory guide elements 4 of visor 2.

The length development of said teeth 8 is such as to permit their resting on an annular bulge 4*a* emerging from the front surface of each guide element 4 of the visor and thereafter their clamping against the same guide element 4 by press-fitting head 3*a* of connection pin 3. Said pins are thereafter stably housed within the annular housings 9 (FIG. 3), defined between the inner surface of heads 3*a* and the external surface of elements 4, and in this way front-piece 6 is jut-fixed above the hinge-line of visor 2.

Figure 3:
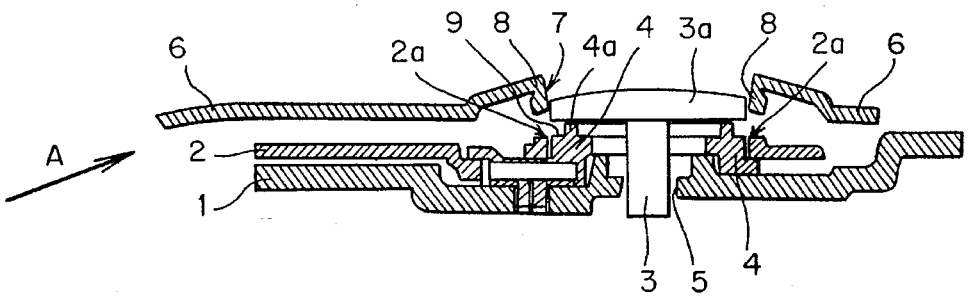
FIG. 3 is the section of FIG. 2, wherein the front-piece is illustrated during the detachment from the helmet cap.

In case of hittings of the front-piece against obstacles, said front-piece undergoes a stress, for instance following arrow A of FIG. 3 (or even in the opposite direction or in whatever other direction), due to which it tends to tear away teeth 8 from their housing 9, causing the deformation of peduncles 8*a*, which, having a smaller section, facilitate the coming out of the teeth from their housing 9 and therefore the easy detachment of the front-piece from the helmet.

Figure 5:
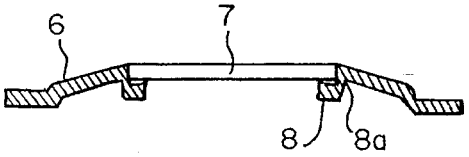
FIG. 5 and 5*a* show, respectively, the detail of one of the stepped-teeth radially orientated with respect to the circular opening provided on one of the two sides of the front-piece, and the same detail in deformed position during the fall or hitting of the user.
Figure 5A:
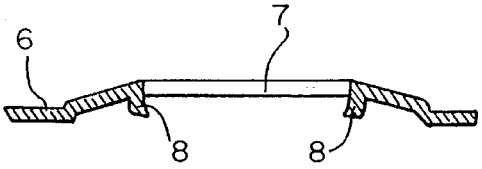

The deformation of peduncles 8*a* causes in fact the shifting of teeth 8 from the internal and radial position with respect to openings 7, as shown on FIG. 5, to a position external and parallel to the side surface of the front-piece, as shown on FIG. 5*a*.

The hereinabove description clearly shows the advantages ensuing from the utilization of a front-piece of a rigid material compared with a front-material of deformable material; in particular, the stiffness of the front-piece avoids or reduces markedly the vibrations that may occur during the driving, while the easy and safe detachement from the helmet in case of hittings or the like eliminates any element projecting from the helmet which might cause damages to the user.

Obviously, in the practical realization, structurally and functionally equivalent changes and variants can be made to the hereinabove invention described according to one of its preferred embodiment, as well as variants in the materials used, size, colour and shape of the front-piece, all of them falling within the scope of protection of this invention.

I claim:

1. Crash-helmet provided with a visor front-piece, comprising a cap body said visor front-piece is made of rigid material and is stably jut-fixed to connection side pins on the cap body by cog means partly deformable and so sized as to permit the prompt detachment of the front-piece from said helmet pins, said cog means are constituted by a plurality of elements shaped as stepped-teeth, radially projecting towards the inside of two circular openings, each such opening being provided at the opposite ends of the front-piece, in such a way as to be arrangeable coaxially to one of said connection pins, the holding of said front-piece being obtained by the partial fitting of said stepped-teeth into an annular housing, defined, in correspondence of each connection pin, between the head of said pins and an annular body utilized for the rotatably holding of the liftable visor.

2. Crash-helmet according to claim 1, comprising said stepped-teeth are integral with the front-piece and spaced from this by means of a peduncle-shaped part of smaller section, so as to allow the front-piece, in case of hitting and falling of the helmet user, to cause the coming out of the stepped-teeth from the relevant annular housings and the ensuing detachment from the cap body, as a consequence of the deformation undergone by said smaller section peduncles.

3. Crash-helmet according to claim 1, wherein said cap body is a type selected from the group consisting of integral-type and open-front.

* * * * *